US007372970B2

(12) United States Patent
Ach-Kowalewski

(10) Patent No.: US 7,372,970 B2
(45) Date of Patent: May 13, 2008

(54) POCKET HEARING AID

(75) Inventor: Gerhard Ach-Kowalewski, Effeltrich (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 625 days.

(21) Appl. No.: 11/064,732

(22) Filed: Feb. 24, 2005

(65) Prior Publication Data

US 2005/0190937 A1 Sep. 1, 2005

(30) Foreign Application Priority Data

Feb. 26, 2004 (DE) ..... 10 2004 009 269

(51) Int. Cl.
*H04R 25/00* (2006.01)

(52) U.S. Cl. ..... 381/322; 381/315; 381/324

(58) Field of Classification Search ..... 381/312, 381/315, 322, 323, 324, 327, 328, 330, 370, 381/380–381, 384; 455/351; 600/25; 607/56, 607/57; 181/129, 130, 135
See application file for complete search history.

(56) References Cited

U.S. PATENT DOCUMENTS 3,209,081 A * 9/1965 Ducote et al. ..... 600/25
5,721,783 A 2/1998 Anderson
6,748,094 B1 * 6/2004 Tziviskos et al. ..... 381/330
7,231,181 B2 * 6/2007 Kohli et al. ..... 455/41.2

FOREIGN PATENT DOCUMENTS

DE 35 08 830 A1 9/1986
DE 203 03 190 U1 6/2003

* cited by examiner

*Primary Examiner*—Huyen Le

(57) ABSTRACT

Pocket hearing aids are to be designed to be more comfortable. To this end there is provision on one hand for a wireless communication connection to be established between the microphone part and the earpiece part. To this end the microphone device of the pocket hearing aid has an appropriate electronics section (1) and an antenna (4), which can simultaneously be used as a clip. In order on the other hand to be able to dispense with feeding in external signals over a cable connection, the microphone device further features an adapter connector (5) with which for example it can be plugged in directly to a training device, a stereo device or a mobile telephone.

10 Claims, 1 Drawing Sheet

POCKET HEARING AID

CROSS REFERENCE TO RELATED APPLICATIONS

This application claims priority to the German application No. 10 2004 009 269.9, filed Feb. 26, 2004 which is incorporated by reference herein in its entirety.

FIELD OF INVENTION

The present invention relates to a pocket hearing aid with a microphone device for picking up and processing sound signals and an earpiece device to which the microphone device has a communication connection but is constructionally separate.

BACKGROUND OF INVENTION

In numerous areas of life hearing aid wearers can resort to what are known as pocket hearing aids. This is useful for example on training courses but also for the use of mobile telephones, stereo equipment and comparable media.

With a pocket hearing aid the microphone device including the signal processing is constructively separate from the earpiece. A device which can be carried in the breast pocket for example receives the audio signals, processes them and directs them over an appropriate cable connection to an earpiece which the hearing aid wearer wears in a/on their ear.

The output signals of training devices, mobile telephones, stereo systems and such like are provided for example through Euro jack plugs. The pocket hearing aid possesses an audio shoe which serves as an adapter for the hearing aid. The audio signals are transmitted from the relevant device output over a standard cable to the audio shoe of the hearing aid.

In addition it is known from publication U.S. Pat. No. 5,721,783 that wireless transmission of signals from an external device to a hearing aid is possible. These types of external devices, which can be referred to as RPUs (remote processor unit), can be produced for example in the form of a wristwatch or a piece of jewelry.

Utility model DE 203 03 190 U1 further discloses a handsfree device for hearing aids to allow hearing aid wearers to use mobile telephones, digital telephones and CD players. Here a support element of a behind-the-ear hearing aid features a coil which is connected by means of a lead via a microphone to a plug for direct connection to the devices to be used.

The further publication DE 35 08 830 A1 describes a hearing aid in which the earpiece is located outside the hearing aid housing in an otoplastic. The connection between an amplifier of the hearing aid and the earpiece is a wireless connection.

SUMMARY OF INVENTION

The object of the present invention is to provide a pocket hearing aid which is more user-friendly in its handling.

In accordance with the invention this object is achieved by the claims.

Advantageously this allows an audio shoe on the hearing aid to be dispensed with. Over and above this a disruptive cable between an audio device and the pocket hearing aid can be avoided.

A wireless communication connection between the microphone and the earpiece allows the cable which is usually employed here to be dispensed with as well. This increases the acceptance of these types of pocket hearing aids especially for use in training courses and suchlike.

The male plug-in connection unit preferably consists of a jack plug. This makes it compatible with audio outputs which are used in large numbers in audio devices.

It is especially preferable if on the pocket hearing aid the microphone device on the one hand features the male plug-in connection unit and on the other hand can be linked via a wireless communication connection to the earpiece device. This means that, particularly with training courses or when using mobile telephones, it is possible to dispense with any form of cable connection for communications, which increases the user convenience accordingly.

The wireless communication connection can be set up using the Micro Link method or the Bluetooth standard. This means that standardized communication methods and interfaces can be used.

In a particular embodiment of the pocket hearing aid in accordance with the invention the hearing aid can be embodied as an in-the-ear ItE or behind-the-ear BtE hearing aid. The advantage of this is that the hearing aid wearer cannot just perceive the sounds or the audio signals that are picked up by the microphone device but also the sound signals which are coming into his ear. In addition a hearing aid wearer in this case does not have to take off the hearing aid and use a special earpiece of the pocket hearing aid.

Expediently the microphone device possesses a volume control. This enables the level of the transmitted signal to be controlled, which is particularly advantageous when the hearing aids are used as earpieces since then the volume control setting of the hearing aid can remain unchanged.

The microphone device can further feature an antenna embodied as a retaining clip. This has the advantage that the pocket hearing aid can be attached to a breast pocket like a ball point pen for example and in addition the retaining clip has the additional functionality so that a weight saving can be achieved.

In a further preferred embodiment the earpiece device possesses a removable receiver module. This makes it possible to change from wireless communication to wired communication, to replace a defective receiver module without any great effort and if necessary, by replacing the receiver module, to convert to another communication technology.

The connector installed on the inventive pocket hearing aid can also be used as a programming interface. This allows a specific plug-in device for programming the pocket hearing aid to be dispensed with.

BRIEF DESCRIPTION OF THE DRAWINGS

The invention will now be explained in more detail on the basis of the enclosed drawings, which show.

The exemplary embodiments described in greater detail below represent preferred embodiments of the present invention.

DETAILED DESCRIPTION OF INVENTION

Figure 1:
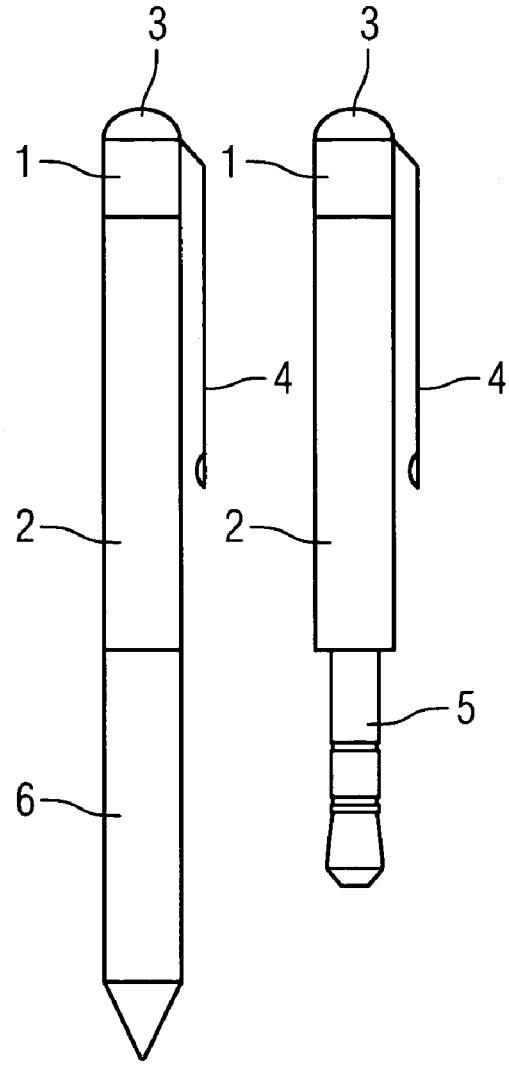
FIG. 1 an overhead view of an inventive pocket hearing aid with a cap and a pocket hearing aid without a cap.
Figure 2:
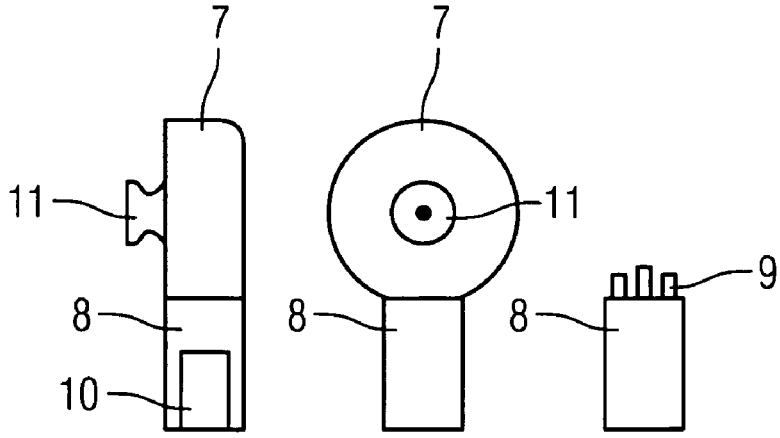
FIG. 2 an overhead view and a side view of an inventive earpiece and receiver module.

A pocket hearing aid in accordance with the invention consists of a transmit part as per FIG. 1 and a receive part as per FIG. 2. The transmit part from FIG. 1 in the present example has the external form of a ball point pen. The upper section of the transmit part which is also referred to in this document as the microphone device, carries the microphone 1 along with its electronics section. Coaxially below this is arranged a battery compartment 2 to supply power to the microphone 1 or electronics section. The volume can be controlled with the aid of a volume control 3 which is shown in FIG. 1 arranged above the micro phone. If the pocket hearing aid is not equipped with a volume control a blanking plate can also be provided at this point.

An antenna is further arranged at the microphone 1 or electronics section which is embodied in the present case as a clip 4. This allows the transmit section or microphone device to be securely attached to thin objects such as for example the material of a breast pocket.

At the opposite end of the transmit part to the microphone 1 an adapter connector 5 is arranged. In the present case it is embodied as a jack plug so that it can be plugged into standardized audio outputs of audio devices. If the connector is embodied in a suitable way it can also be used to transmit energy for the microphone 1 or the electronics section so that under some circumstances it is possible to dispense with the use of a battery or a battery compartment 2.

A cover or cap 6 like a fountain pen top can be provided to cover the adaptor plug 5. This gives the adaptor plug 5 better protection against damage.

The transmit part including the adapter plug 5 thus represents an adaptor module which because of its permanently-fitted jack plug 5 can be easily plugged into media, for example a stereo system, a television, a training device, a mobile telephone etc. without any effort or additional equipment.

FIG. 2 shows a corresponding receive part of the pocket hearing aid in a side view on the left, an overhead view in the middle and without an earpiece on the right. The earpiece 7 which is embodied as a cylinder here can be plugged into a receiver module 8. To this end the earpiece or loudspeaker (7) has a corresponding audio shoe (not shown) and the receiver module 8 the mirrored plug-in connection 9. With the aid of this plug-in connection communication to the earpiece can also be wired for example.

The receive module 8 further has a battery compartment 10 into which a battery can be inserted to supply power to the entire receiver section including the earpiece 7.

Finally the earpiece or loudspeaker 7 has on its faces a connector section 11, with which the receive part or the earpiece 7 can be attached to an SE cavity or to another type of otoplastic or holder.

The inventive pocket hearing aid can now be used as follows: The transmit part is for example plugged into a training device or a television. It then transmits signals received via the adaptor connector 5 wirelessly to be receive part 7 to 11 which is attached to the otoplastic of a hearing aid wearer.

In a simplified version of the pocket hearing aid in accordance with the invention the microphone device 1 to 6 does not possess a transmitter and the earpiece device has no receiver module 8 and there is a cable connection between the two parts. In this case the microphone device can still be plugged into the training device for example and the corresponding signals are transmitted over wires to the earpiece 7. The user can however not move away from the training device. Despite this, this variant has the advantage that a cable connection between the microphone device and the training device can be dispensed with because of the adaptor plug 5 provided.

With a further embodiment there is a wireless communication connection between the microphone device and the earpiece device of the pocket hearing aid, but the microphone device does not have the adapter connector 5. In this case the microphone device, provided it features a corresponding input jack can be connected to the training device by a suitable cable. This means that data transmission with this variant is initially by wire to the microphone section and subsequently wireless onward to the earpiece device.

In a further development of the present invention there can also be provision for a the microphone 1 to be able to be switched off in the microphone device or the transmit section. This can be advantageous if the user exclusively wishes to concentrate on the electrically fed-in audio signals.

The invention claimed is:

1. A pocket hearing aid, comprising:

an integrated microphone device including a hearing aid electronics unit for acquiring and processing sound signals; and an acoustic earpiece operatively connected the microphone device, the acoustic earpiece embodied as a separate unit, wherein the microphones device comprises a male plug-in connector fixed to the microphone device, the male plug-in connector sized and configured to directly connect the microphone device to an audio output jack of an audio system for directly transmitting an electrical audio signal generated by the audio system to the microphone device.

2. The pocket hearing aid according to claim 1, wherein the microphone device and the acoustic earpiece are adapted to communicate wirelessly.

3. The pocket hearing aid according to claim 1, where the plug-in connector comprises a phone jack.

4. The pocket hearing aid according to claim 2, wherein the microphone device and the acoustic earpiece are adapted to communicate wirelessly using the Microlink-Method.

5. The pocket hearing aid according to claim 2, wherein the microphone device and the acoustic earpiece are adapted to communicate wirelessly using the Bluetooth Method.

6. The pocket hearing aid according to claim 1, wherein the acoustic earpiece is an ItE hearing aid.

7. The pocket hearing aid according to claim 1, wherein the acoustic earpiece is a BtE hearing aid.

8. The pocket hearing aid according to claim 1, wherein the microphone device comprises a volume control unit.

9. The pocket hearing aid according to claim 1, wherein the microphone device comprises an antenna unit formed as a retaining clip.

10. The pocket hearing aid according to claim 1, wherein the acoustic earpiece comprises a detachable receiver unit for receiving communication signals transmitted by the microphone device.

* * * * *